US009254017B2

(12) United States Patent
Murtha et al.

(10) Patent No.: US 9,254,017 B2
(45) Date of Patent: Feb. 9, 2016

(54) EXPANDABLE FOOTWEAR FOR CHILDREN

(71) Applicant: DM3, Inc., New York, NY (US)

(72) Inventors: Matthew Murtha, New York, NY (US); Dawn May, New York, NY (US)

(73) Assignee: DM3, Inc., New York, NY (US)

( * ) Notice: Subject to any disclaimer, the term of this patent is extended or adjusted under 35 U.S.C. 154(b) by 515 days.

(21) Appl. No.: 13/738,750

(22) Filed: Jan. 10, 2013

(65) Prior Publication Data

US 2014/0190039 A1 Jul. 10, 2014

(51) Int. Cl.

| | |
|---|---|
| ***A43B 3/26*** | (2006.01) |
| ***A43B 3/30*** | (2006.01) |
| ***A43B 19/00*** | (2006.01) |

(52) U.S. Cl.

CPC ... *A43B 3/26* (2013.01); *A43B 3/30* (2013.01); *A43B 19/00* (2013.01)

(58) Field of Classification Search

CPC ..... A43B 3/26; A43B 3/30; A43C 11/12
USPC ..... 36/97, 112
See application file for complete search history.

(56) References Cited

U.S. PATENT DOCUMENTS 1,648,101 A * 11/1927 Ascheim ..... A43C 11/12 36/50.1
2,302,596 A * 11/1942 Bigio ..... A43B 3/24 36/101
3,059,352 A * 10/1962 Clason ..... A43C 11/12 12/146 C
4,665,634 A * 5/1987 Diaz ..... A43B 3/30 36/112
5,020,247 A * 6/1991 Barret ..... A43B 1/0072 36/117.2
6,604,477 B1 * 8/2003 Hozan ..... A43B 7/12 112/475.16
7,287,294 B2 * 10/2007 Miller ..... A43B 3/26 12/145
8,136,267 B2 * 3/2012 Barnett ..... A41D 15/00 24/416
8,935,861 B2 * 1/2015 Baker ..... A43B 1/0018 36/128
2015/0096201 A1 * 4/2015 Marcon ..... A43B 7/125 36/109

* cited by examiner

*Primary Examiner* — Ted Kavanaugh
(74) *Attorney, Agent, or Firm* — Mark Terry

(57) ABSTRACT

An expandable bootie is disclosed. The bootie includes a main body composed of fabric, wherein the main body is shaped in the form of a foot having a longitudinal axis, and a zipper that commences at a toe portion of the main body, and extends in a spiral path around the main body such that the spiral path twists at least three hundred and sixty degrees around the main body. The bootie further includes a portion of fabric disposed between mating tape members of the zipper, wherein when the zipper is closed the portion of fabric is contracted and wherein when the zipper is open the portion of fabric is extended and the main body has a longer longitudinal length, and a strap comprising a strip extending substantially horizontally and connected to an ankle portion of the main body.

6 Claims, 10 Drawing Sheets

EXPANDABLE FOOTWEAR FOR CHILDREN

CROSS-REFERENCE TO RELATED APPLICATIONS

Not Applicable.

STATEMENT REGARDING FEDERALLY SPONSORED RESEARCH OR DEVELOPMENT

Not Applicable.

INCORPORATION BY REFERENCE OF MATERIAL SUBMITTED ON A COMPACT DISC

Not Applicable.

FIELD OF THE INVENTION

The invention disclosed broadly relates to the field of clothing and garments, and more particularly relates to the field of footwear for children.

BACKGROUND OF THE INVENTION

Children, especially infants, grow at a rapid pace. As a result, children are constantly outgrowing their clothing and parents struggle to provide their children with properly fitting clothing. This problem is especially pronounced in the area of footwear. Whereas ill-fitting clothing may only look out of place, shoes that do not fit properly can also cause aches and pains to the wearer. Further, since children's feet are in the growth phase, their delicate feet can be negatively affected by wearing shoes that are too tight. Thus, when caring for a child, there is a constant need to provide properly fitting footwear. This can be wasteful for families finding themselves making multiple footwear purchases following multiple growth spurts Some attempts have been made to provide expandable shoes. U.S. Pat. No. 3,389,481, for example, discloses a shoe in which a two plate assembly is disposed between an inner and a disjointed outer sole, having overlapping front and back portions. One of the plates includes a spring tongue, and the other plate includes two apertures to receive the spring tongue, each aperture corresponding to a shoe size. To adjust the shoe size, a screw which extends through the heel and into the disjointed soles is removed. The shoe may then be pulled apart allowing the disjointed sole to separate until the spring tongue engages the next aperture. Thus the shoe size may be lengthened by one size, but apparently the size cannot be controlled finely or reduced. The shoe includes two crinkled leather portions, one on each side of the shoe, to facilitate expansion of the shoe. The apparatus of U.S. Pat. No. 3,389,481, however, is a complex device with a multitude of moving parts composed of a variety of materials. These characteristics are disadvantageous since they increase manufacturing costs, enhance the probability of failure of the product and increase the consumer sales price.

In another example, international patent application WO 01/33986 also describes an expandable shoe. The expandable shoe includes an outer shell having a front and a rear outer assembly each attached to a flexible, expandable segment. An adjustable inner assembly is disposed within the outer shell and includes a control mechanism, accessible from the outer shell, which may be urged from a lock state into a state in which the inner assembly and outer shell may be adjusted. A visualization window provides a view port to the inner assembly. The apparatus of patent application WO 01/33986, however, is also an intricate device with multiple moving parts composed of different materials.

Consequently, a need exists to overcome the problems with the prior art as discussed above, and particularly for a simpler and more efficient expandable footwear product for children.

SUMMARY OF THE INVENTION

Briefly, according to an embodiment of the present invention, an expandable bootie is disclosed. The bootie includes a main body composed of fabric, wherein the main body is shaped in the form of a foot having a longitudinal axis, and a zipper embedded in the fabric of the main body, wherein the zipper commences at a toe portion of the main body, and extends in a spiral path around the main body such that the spiral path twists at least three hundred and sixty degrees around the main body. The bootie further includes a portion of fabric disposed between mating tape members of the zipper, wherein when the zipper is closed the portion of fabric is contracted and the main body has a first longitudinal length along the longitudinal axis, and wherein when the zipper is open the portion of fabric is extended and the main body has a second longitudinal length greater than the first longitudinal length, and a strap comprising a strip extending substantially horizontally and connected to an ankle portion of the main body. The bootie further includes a first portion of hook and loop fabric disposed on an interior side of the strap, and a second portion of hook and loop fabric disposed on the ankle portion of the main body, wherein the second portion of hook and loop fabric is coupled to the first portion of hook and loop fabric, so as to removably couple the strap with the ankle portion of the main body.

The foregoing and other features and advantages of the present invention will be apparent from the following more particular description of the preferred embodiments of the invention, as illustrated in the accompanying drawings.

BRIEF DESCRIPTION OF THE DRAWINGS

The subject matter, which is regarded as the invention, is particularly pointed out and distinctly claimed in the claims at the conclusion of the specification. The foregoing and other features and also the advantages of the invention will be apparent from the following detailed description taken in conjunction with the accompanying drawings. Additionally, the left-most digit of a reference number identifies the drawing in which the reference number first appears.

DETAILED DESCRIPTION

The present invention provides a children's bootie that can easily be extended in longitudinal length via the use of zippers. The present invention is beneficial as it extends the usable life of a child's bootie. A bootie is a soft shoe worn by a child or infant. Also, the Applicant's invention provides a product manufactured from materials that are durable and easily washable. This feature is particularly advantageous since the bootie is meant for children. Further advantages include a reduction in the amount of money spent on footwear for a child, a reduction in the number of visits to clothing and footwear retailers and protection of the environment by increasing the wearable life of the footwear of the present invention.

Figure 1:
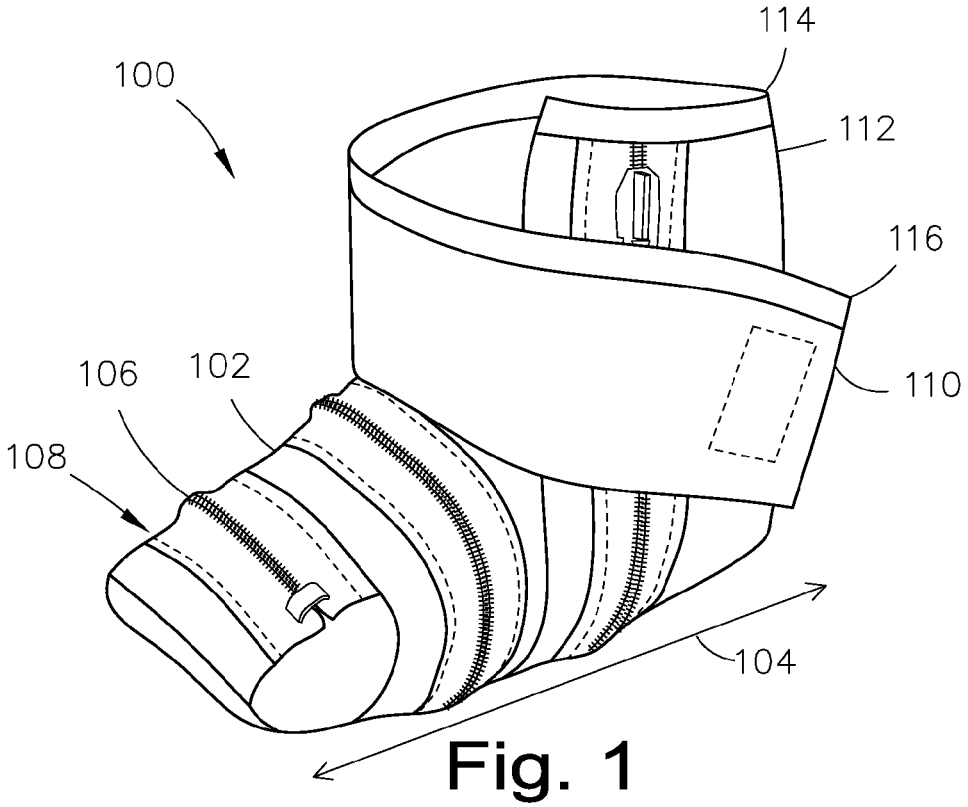
FIG. 1 is an illustration of a top perspective view of an expandable children's bootie, according to one embodiment of the present invention.

Following is a description of a first embodiment of Applicant's invention, with reference to FIGS. 1 through 6. FIG. 1 is an illustration of a top perspective view of an expandable children's bootie 100, according to a first embodiment of the present invention. FIG. 1 shows that the bootie 100 comprises a main body 102 composed of fabric, wherein the main body is shaped in the form of a foot having a longitudinal axis 104. The bootie 100 also includes a zipper 106 embedded in the fabric of the main body 102, wherein the zipper 106 commences at a toe portion 108 of the main body 102, and extends in a spiral path around the main body 106 such that the spiral path twists at least three hundred and sixty degrees around the main body 106. FIG. 1 shows that the zipper 106 commences at a toe portion 108 of the main body 102, and extends in a spiral path around the main body 106 such that the spiral path twists at least seven hundred and twenty degrees around the main body 106. Lastly, FIG. 1 also shows that the zipper 106 may further extend vertically up one side (the left side, in FIG. 1) of the ankle portion 112 of the main body 102.

FIG. 1 shows that bootie 100 also includes a strap 110 comprising a strip extending substantially horizontally and connected to an ankle portion 112 of the main body 102. The top edge 114 of the strap 110 comprises a topline of the bootie 100. A topline of a shoe is the edge or brim of the opening in the shoe that accepts the foot when inserted into the shoe. The strap 110 may comprise border stitching 116 around the top edge 114 or topline of the strap 110.

Figure 3:
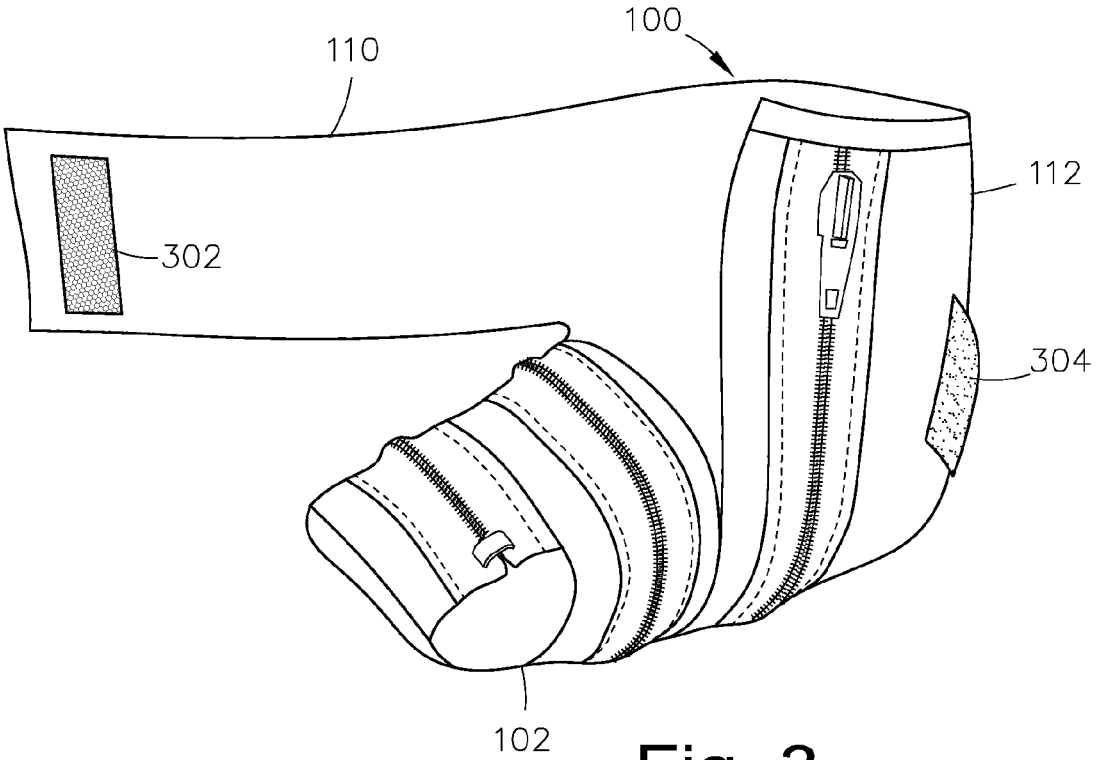
FIG. 3 is an illustration of a top perspective view of the expandable children's bootie of FIG. 1, showing the strap in an open position.
Figure 4:
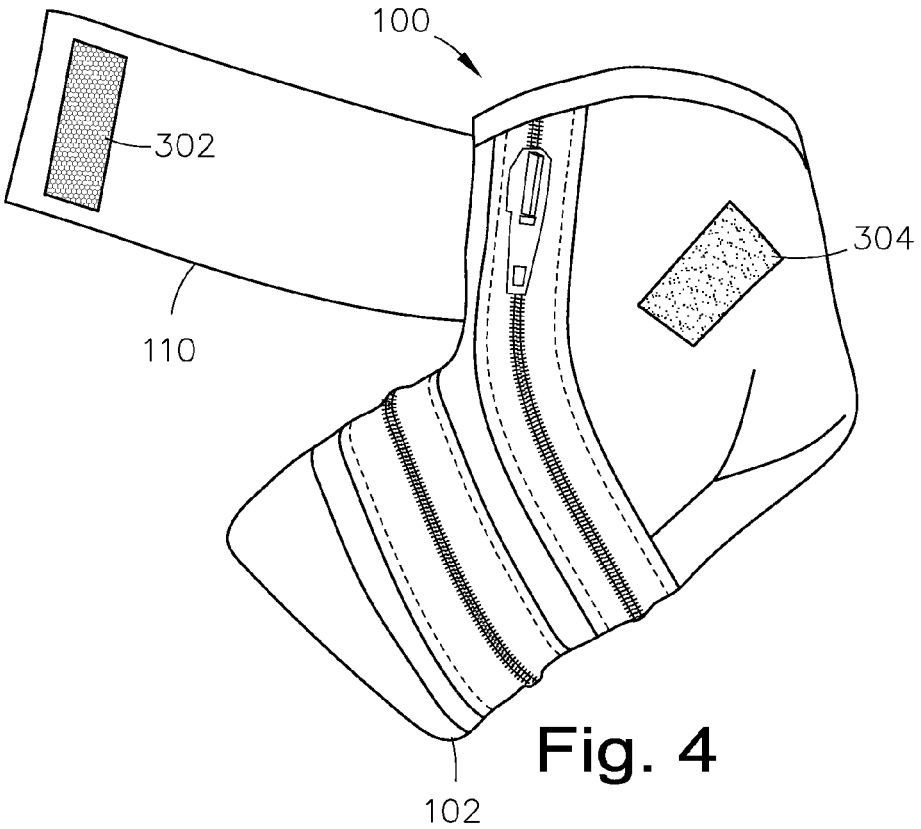
FIG. 4 is an illustration of a bottom perspective view of the expandable children's bootie of FIG. 1, showing the strap in an open position.

FIG. 3 and FIG. 4 show that bootie 100 further comprises a first portion 302 of hook and loop fabric disposed on an interior side of the strap 110. FIG. 3 and FIG. 4 also show that bootie 100 further comprises a second portion 304 of hook and loop fabric disposed on the ankle portion 112 of the main body 102.

Stitching may be located around a circumference of the first portion 302 of hook and loop fabric, wherein the stitching couples the hook and loop fabric to the interior side of the strap 110. Stitching may also be located within a circumference of the first portion of hook and loop fabric, so as to further secure the hook and loop fabric to the interior side of the strap 110. In one embodiment, the first portion 302 of hook and loop fabric may be the hook portion of fabric. Other methods of attaching the hook and loop fabric to the interior side of the strap 110may be used, such as adhesives and the use of a fastener such as a snap. In another embodiment, border stitching may be located around a circumference of the first portion of hook and loop fabric. In yet another embodiment, the first portion of hook and loop fabric and the strap 110 are integrally woven together.

Stitching may be located around a circumference of the second portion 304 of hook and loop fabric, wherein the stitching couples the hook and loop fabric to the ankle portion 112. Stitching may also be located within a circumference of the second portion 304 of hook and loop fabric, so as to further secure the hook and loop fabric to the ankle portion 112. In one embodiment, the second portion 304 of hook and loop fabric may be the loop portion of fabric. Other methods of attaching the hook and loop fabric to the ankle portion 112 may be used, such as adhesives and the use of a fastener such as a snap. In another embodiment, border stitching may be located around a circumference of the second portion of hook and loop fabric. In yet another embodiment, the second portion of hook and loop fabric and the ankle portion 112 are integrally woven together.

Figure 2:
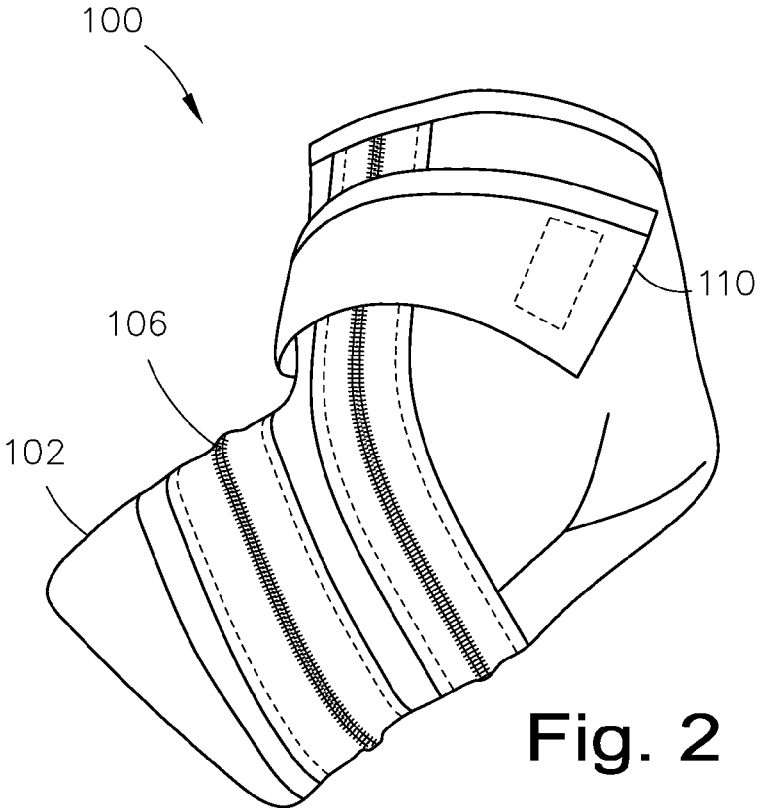
FIG. 2 is an illustration of a bottom perspective view of the expandable children's bootie of FIG. 1.

Whereas FIGS. 1 and 2 show the strap 110 in a closed position, FIGS. 3 and 4 shows the strap 110 in an open position. Thus, FIGS. 1 and 2 show the second portion 304 of hook and loop fabric is coupled to the first portion 302 of hook and loop fabric, so as to removably couple the strap 110 with the ankle portion 112. That is, the hook portion of strap 110 is removably attached to the loop portion of ankle portion 112. When the strap 110 is in the closed position, the bootie 100 is secured to the wearer's foot, so as to keep the bootie 100 from falling off. When the strap 110 is in the open position, the bootie 100 is loosened from the wearer's foot, so as to allow the bootie 100 to be taken off.

Figure 5:
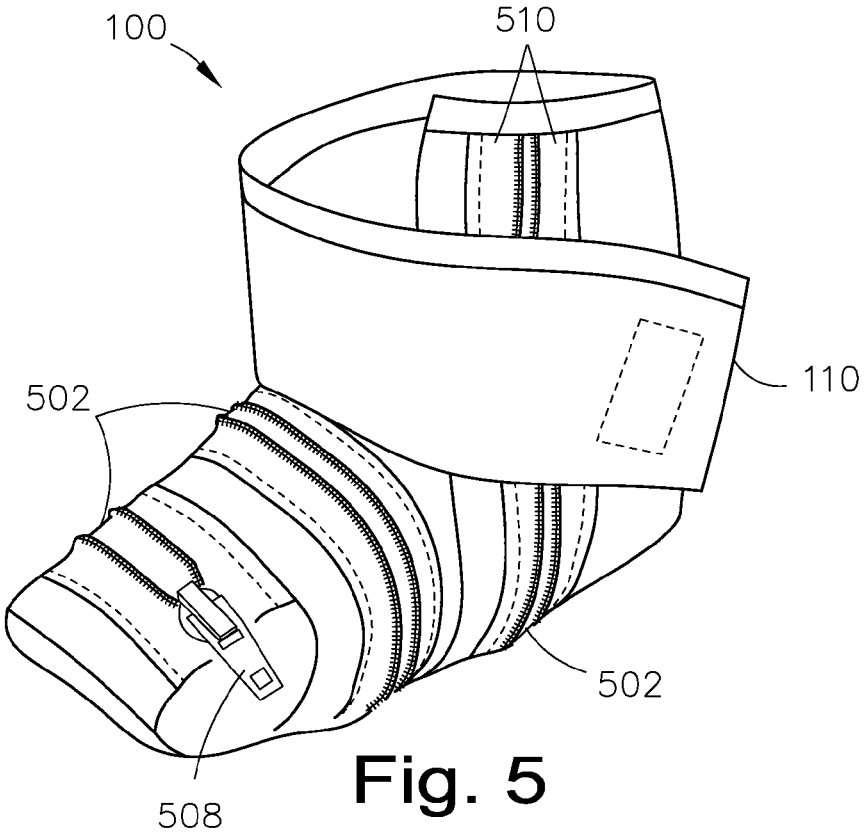
FIG. 5 is an illustration of a top perspective view of the expandable children's bootie of FIG. 1, showing the zipper in an open position.
Figure 6:
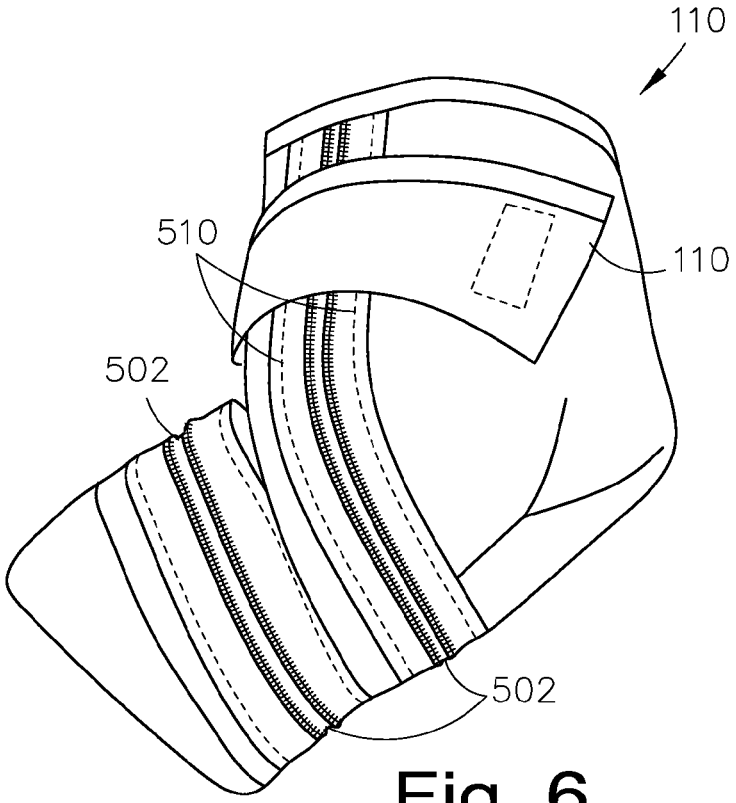
FIG. 6 is an illustration of a bottom perspective view of the expandable children's bootie of FIG. 1, showing the zipper in an open position.

A zipper is a commonly used device for binding the edges of an opening of fabric. The zipper 106 of bootie 100 comprises a pair of mating tape members 510 (see FIG. 5) that are closed when the slider 508 moves in one direction, but that are opened when the slider 508 moves in the opposite direction. Whereas FIGS. 1 through 4 show the zipper 106 in a closed position, FIGS. 5 and 6 show the zipper 106 in an open position. The purpose of placing the zipper 106 in the open position is to increase the longitudinal length of the bootie 100 to accommodate a longer or bigger foot. The mechanism by which the longitudinal length of the bootie 100 is increased is the portion 502 of fabric, which is extended when the zipper 106 is opened.

FIGS. 5 and 6 show the portion 502 of fabric disposed between mating tape members 510 of the zipper 106, wherein when the zipper 106 is closed the portion 502 of fabric is contracted and the main body 102 has a first longitudinal length along the longitudinal axis 104, and wherein when the zipper 106 is open the portion 502 of fabric is extended and the main body 102 has a second longitudinal length greater than the first longitudinal length. Note that although FIGS. 5 and 6 show the zipper 106 being opened along the entire length of the mating tape members 510, an increase in the longitudinal length of the bootie 100 may be realized by opening the zipper 106 along only a portion of the length of the mating tape members 510.

Figure 7:
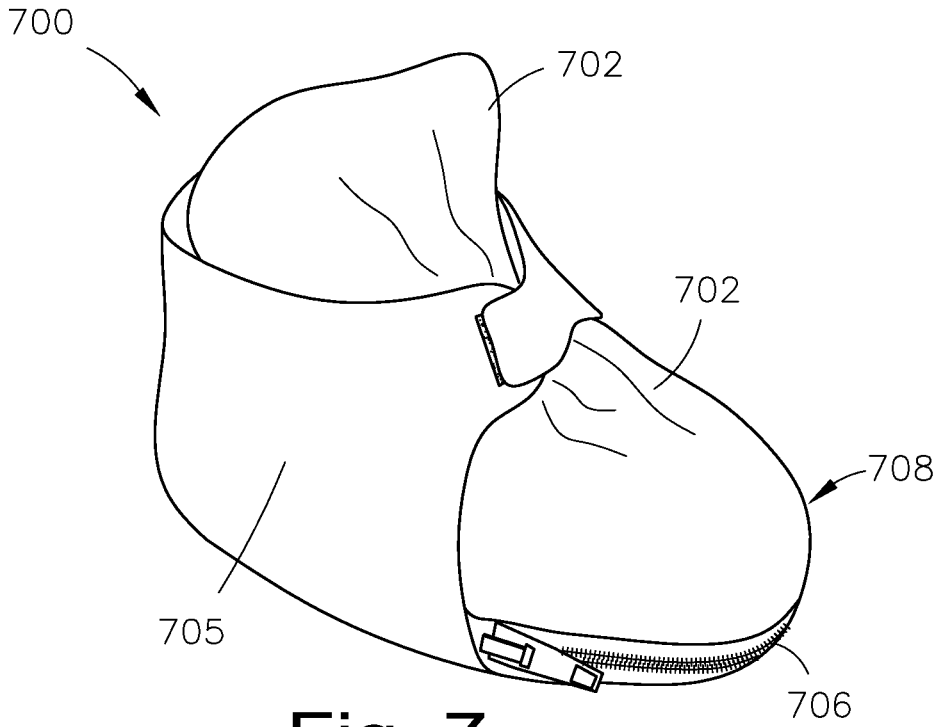
FIG. 7 is an illustration of a top perspective view of an expandable children's bootie, according to a second embodiment of the present invention.

Following is a description of a second embodiment of Applicant's invention, with reference to FIGS. 7 through 10. FIG. 7 is an illustration of a top perspective view of an expandable children's bootie 700, according to a second embodiment of the present invention. FIG. 7 shows that the bootie 700 comprises a vamp and tongue 702 composed of a single portion of fabric. A vamp is a top portion of a shoe and a tongue is a movable piece of a top portion of the shoe that extends toward the ankle of the wearer. Bootie 700 also includes a quarter 705 composed of a single portion of fabric, wherein the quarter extends to both sides and a rear of the bootie 700. A quarter is a portion of a shoe that covers the sides of a shoe. The quarter 705 is a single portion of fabric covers both sides of the bootie 700 and the rear of the bootie 700. Bootie 700 also includes a bottom sole 1002 (not shown in FIGS. 7 through 9 but shown in FIG. 10) coupled with a bottom portion or bottom edge of the quarter 705.

Figure 10:
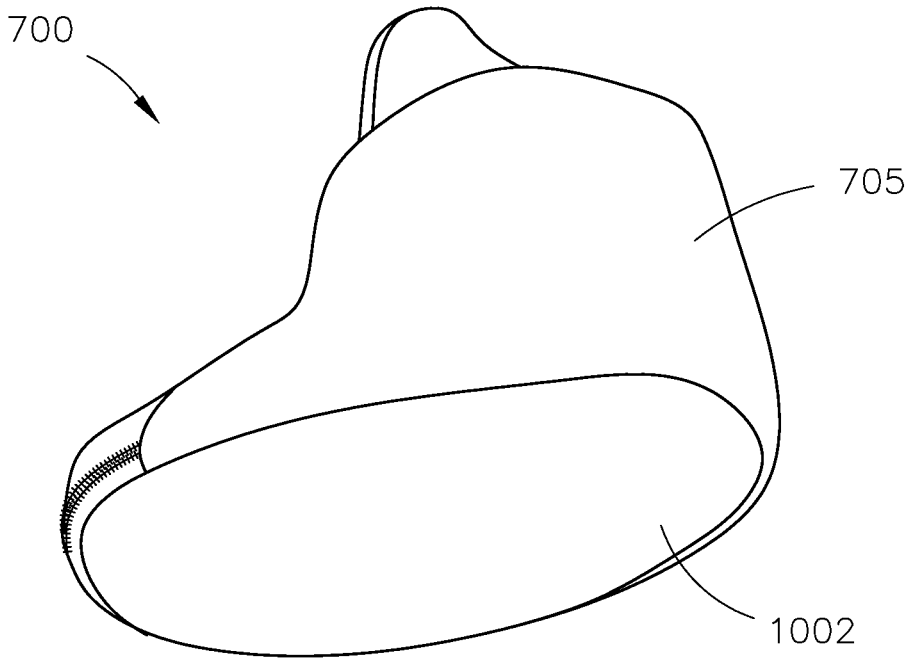
FIG. 10 is an illustration of a bottom perspective view of the expandable children's bootie of FIG. 7.

FIG. 7 also shows that bootie 700 includes a zipper 706 extending substantially horizontally along a toe portion 708 of the bootie 700, wherein the zipper 706 couples the bottom sole 1002 to the vamp and tongue 702 at the toe portion 708 of the bootie 700. FIG. 10 also shows that bootie 700 includes bottom sole 1002 at least partially coupled, via stitching, for example, with a bottom portion or bottom edge of the quarter 705.

Figure 8:
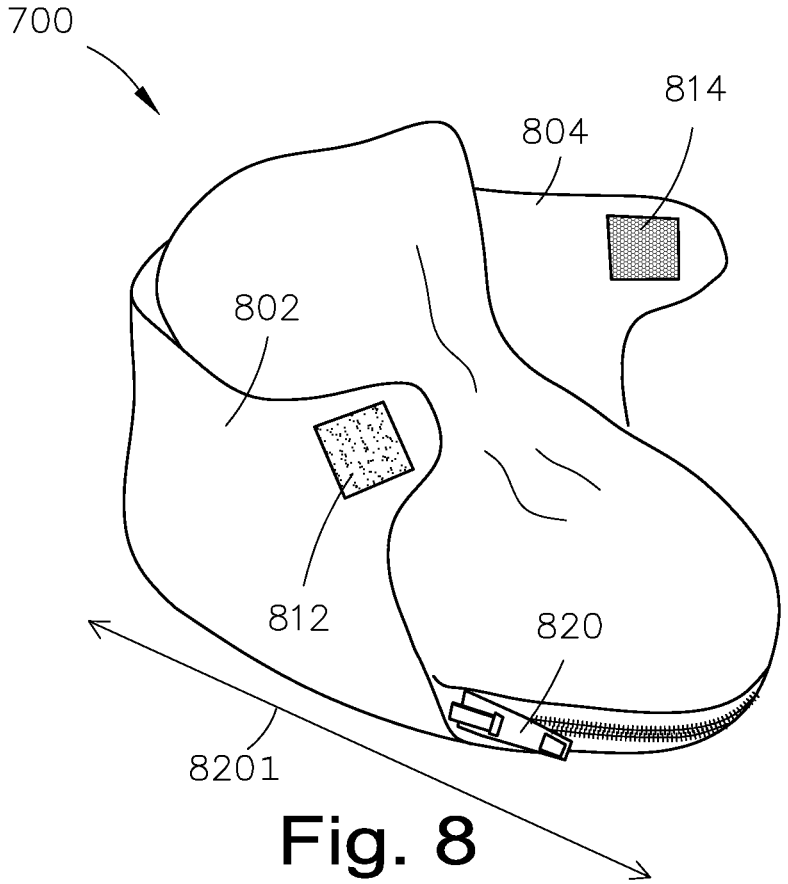
FIG. 8 is an illustration of a top perspective view of the expandable children's bootie of FIG. 7, showing the flaps in an open position.

FIG. 8 shows that bootie 700 comprises a first flap 804 composed of a section of a left side of the quarter 705, wherein the first flap 804 includes a first portion 814 of hook and loop fabric disposed on a first side of the first flap 804. In one embodiment, the first portion 814 of hook and loop fabric may be the hook portion of fabric and the first side of the first flap 804 may be the interior side of the first flap 804. The first portion 814 of hook and loop fabric may be secured to the first flap 804 as described above for bootie 100, such as by stitching. FIG. 8 also shows that bootie 700 comprises a second flap 802 composed of a section of a right side of the quarter 705, wherein the second flap 802 includes a second portion 812 of hook and loop fabric disposed on a second side of the second flap 802. In one embodiment, the second portion 812 of hook and loop fabric may be the loop portion of fabric and the second side of the second flap 802 may be the exterior side of the second flap 802. The second portion 812 of hook and loop fabric may be secured to the second flap 802 as described above for bootie 100, such as by stitching.

Figure 9:
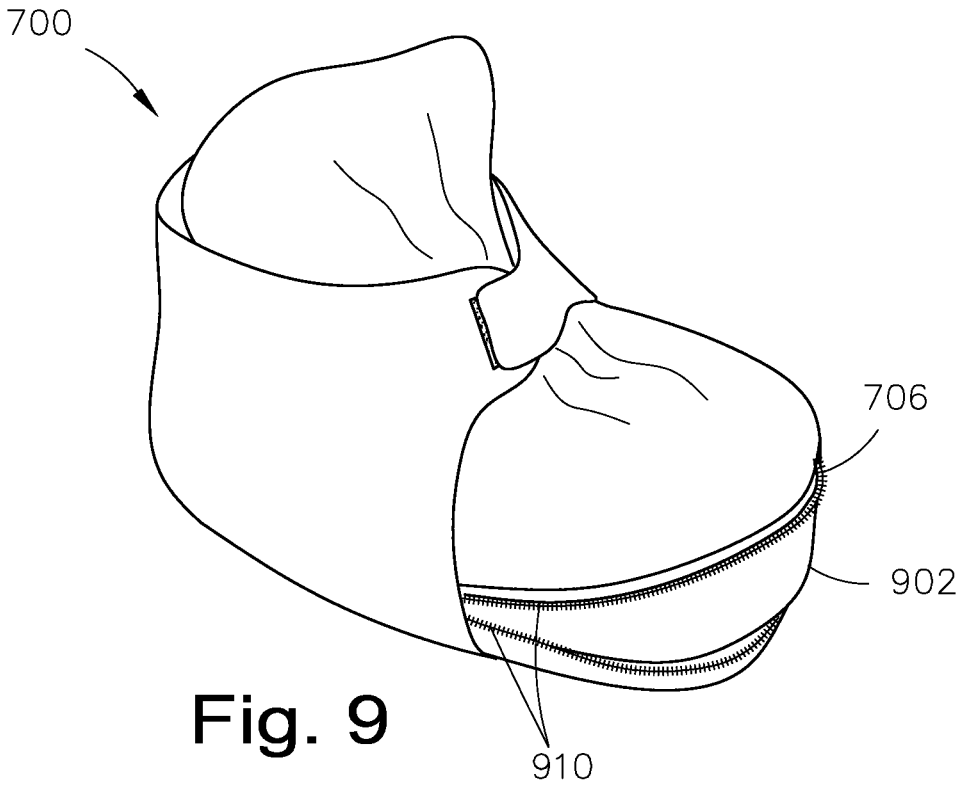
FIG. 9 is an illustration of a top perspective view of the expandable children's bootie of FIG. 7, showing the zipper in an open position.

Whereas FIGS. 7 and 9 show the flaps 802, 804 in a closed position, FIG. 8 shows the flaps 802, 804 in an open position. Thus, FIGS. 7 and 9 show the second portion 812 of hook and loop fabric is coupled to the first portion 814 of hook and loop fabric, so as to removably couple the first flap 804 with the second flap 802. That is, the hook portion of flap 804 is removably attached to the loop portion of flap 802. When the flaps 802, 804 are in the closed position, the bootie 700 is secured to the wearer's foot, so as to keep the bootie 700 from falling off. When the flaps 802, 804 are in the open position, the bootie 700 is loosened from the wearer's foot, so as to allow the bootie 700 to be taken off.

FIG. 9 shows that bootie 700 comprises a portion 902 of fabric disposed between mating tape members 910 of the zipper 706, wherein when the zipper 706 is closed the portion 902 of fabric is contracted and the bootie 700 has a longitudinal length along the longitudinal axis 8201, and wherein when the zipper 706 is open the portion 902 of fabric is extended outward along the longitudinal axis 8201, thereby extending the longitudinal length of the bootie 700.

The zipper 706 of bootie 700 comprises a pair of mating tape members 910 (see FIG. 9) that are closed when the slider 820 moves in one direction, but that are opened when the slider 820 moves in the opposite direction. The purpose of placing the zipper 706 in the open position is to increase the longitudinal length of the bootie 700 to accommodate a longer or bigger foot. The mechanism by which the longitudinal length of the bootie 700 is increased is the portion 902 of fabric, which is extended when the zipper 706 is opened.

Figure 11:
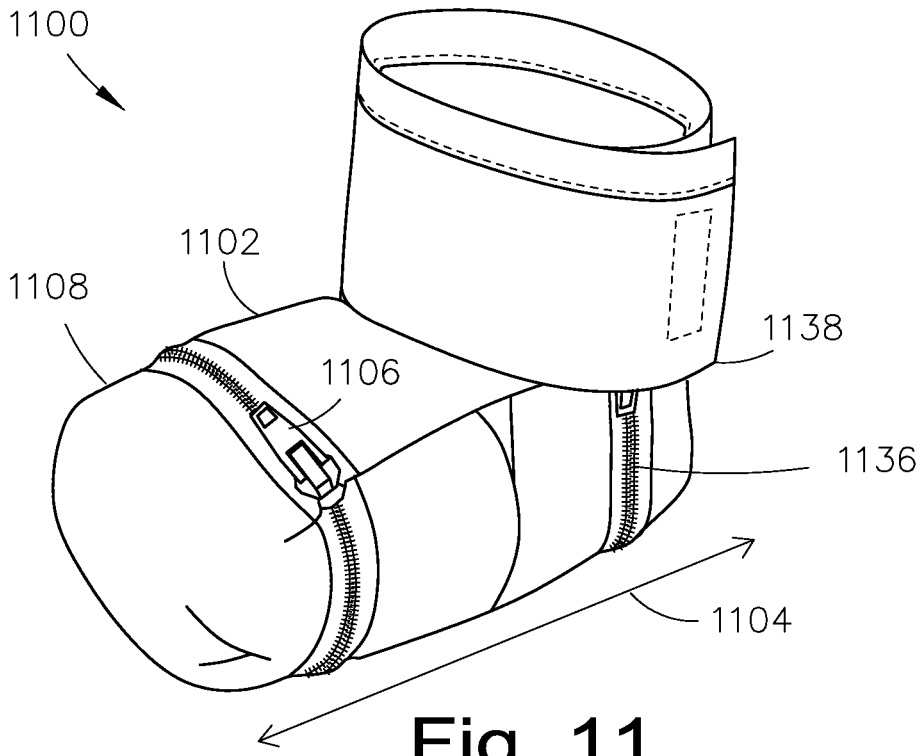
FIG. 11 is an illustration of a top perspective view of an expandable children's bootie, according to a third embodiment of the present invention.
Figure 12:
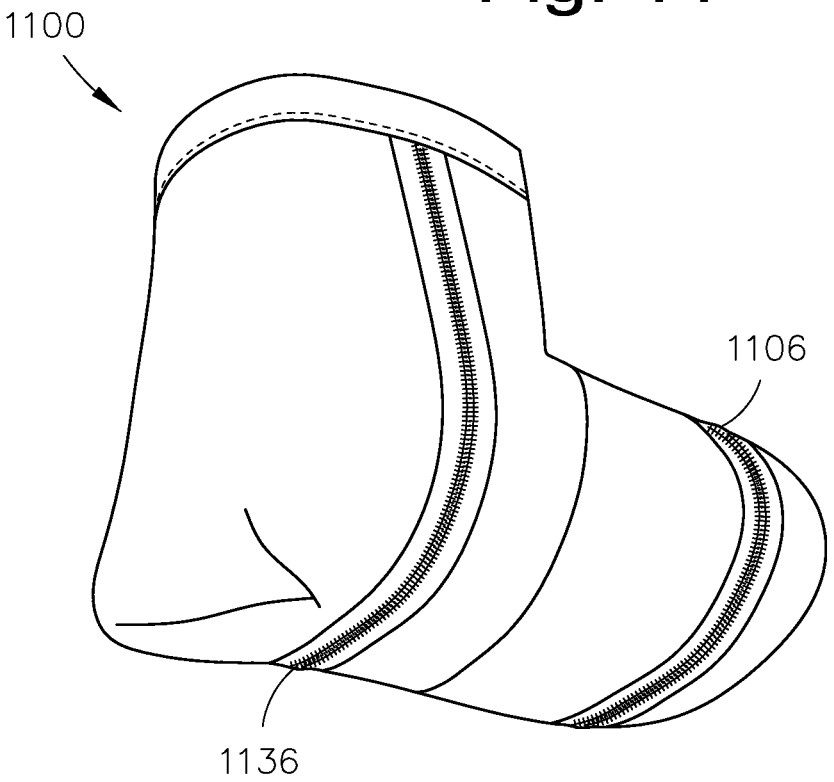
FIG. 12 is an illustration of a bottom perspective view of the expandable children's bootie of FIG. 11.

Following is a description of a third embodiment of Applicant's invention, with reference to FIGS. 11 through 16. FIG. 11 is an illustration of a top perspective view of an expandable children's bootie 1100, according to a third embodiment of the present invention. The bootie 1100 includes a main body 1102 composed of fabric, wherein the main body is shaped in the form of a foot having a longitudinal axis 1104. The bootie 1100 also includes a zipper 1106 embedded in the fabric of the main body 1102, wherein the zipper 1106 commences at a toe portion 1108 of the main body 1102, and extends around the main body 1102 such that the zipper 1106 twists at least three hundred and sixty degrees around the main body 1102. The bootie 1100 also includes a zipper 1136 embedded in the fabric of the main body 1102, wherein the zipper 1136 commences at a first side of an ankle portion 1138 of the main body 1102 and extends under the main body to reach a second side of the ankle portion 1138 of the main body 1102. FIG. 12 is an illustration of a bottom perspective view of the expandable children's bootie 1100 of FIG. 11.

Figure 13:
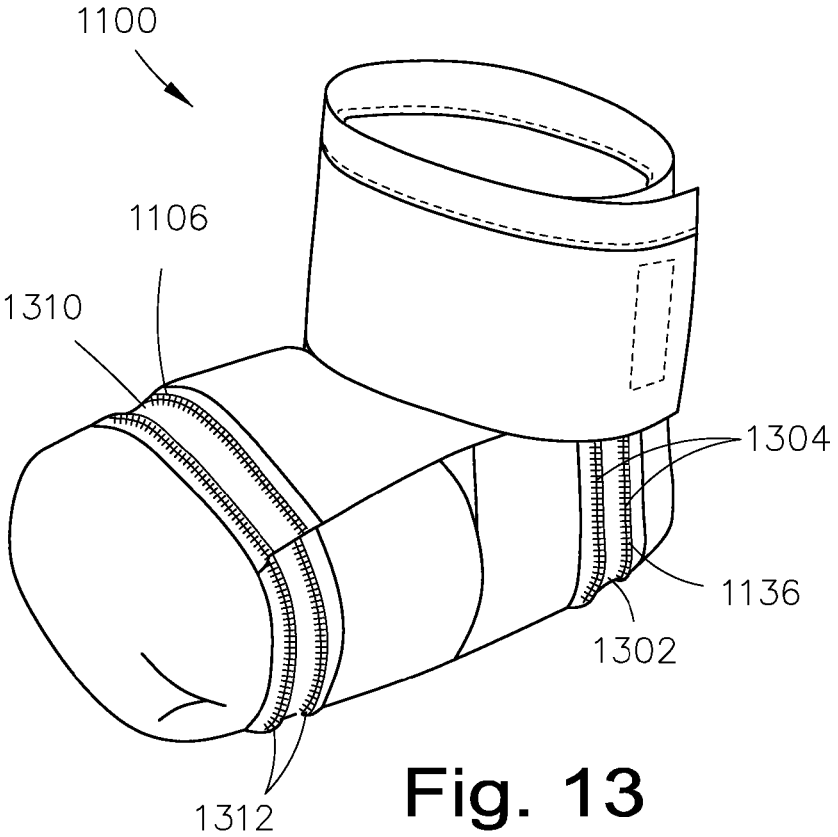
FIG. 13 is an illustration of a top perspective view of the expandable children's bootie of FIG. 11, showing the zippers in an open position.

FIG. 13 is an illustration of a top perspective view of the expandable children's bootie 1100 of FIG. 11, showing the zippers 1106 and 1136 in an open position. FIG. 13 shows that bootie 1100 includes a first portion 1302 of fabric disposed between mating tape members 1304 of the zipper 1136, wherein when the zipper 1136 is closed the first portion 1302 of fabric is contracted and the main body 1102 has a first longitudinal length along the longitudinal axis 1104, and wherein when the zipper 1136 is open the first portion 1302 of fabric is extended and the main body 1102 has a second longitudinal length greater than the first longitudinal length.

Figure 14:
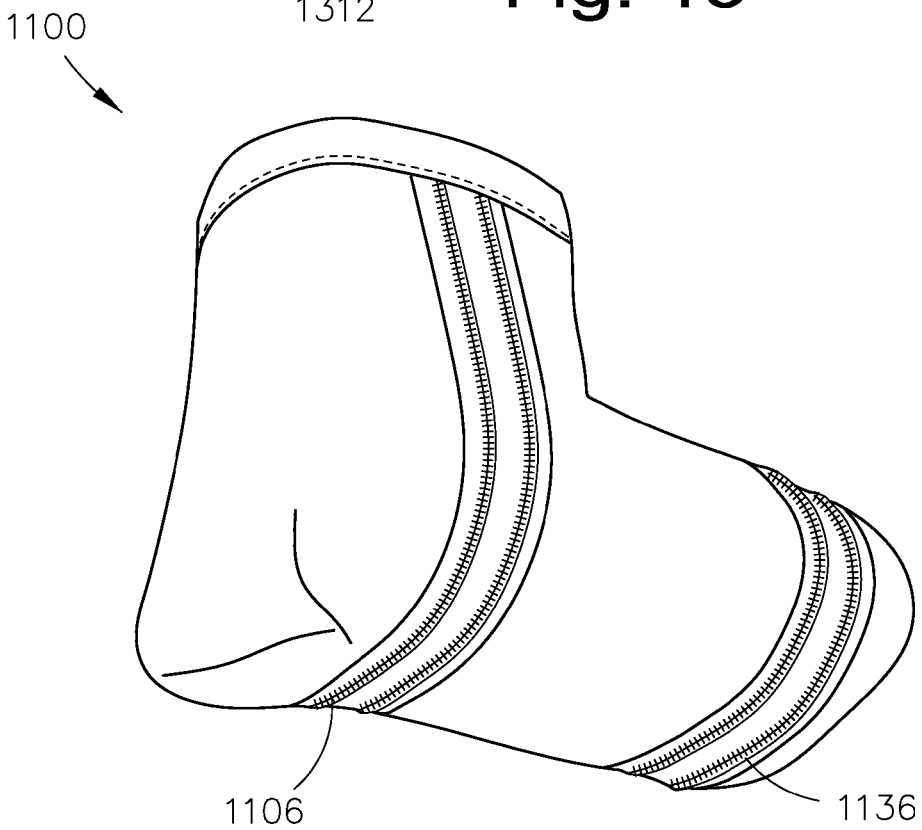
FIG. 14 is an illustration of a bottom perspective view of the expandable children's bootie of FIG. 11, showing the zippers in an open position.

FIG. 13 also shows that bootie 1100 includes a second portion 1310 of fabric disposed between mating tape members 1312 of the zipper 1106, wherein when the zipper 1106 is closed the second portion 1310 of fabric is contracted and the main body 1102 has a third longitudinal length along the longitudinal axis 1104, and wherein when the zipper 1106 is open the second portion 1310 of fabric is extended and the main body 1102 has a fourth longitudinal length greater than the third longitudinal length. FIG. 14 is an illustration of a bottom perspective view of the expandable children's bootie of FIG. 11, showing the zippers in an open position.

Figure 15:
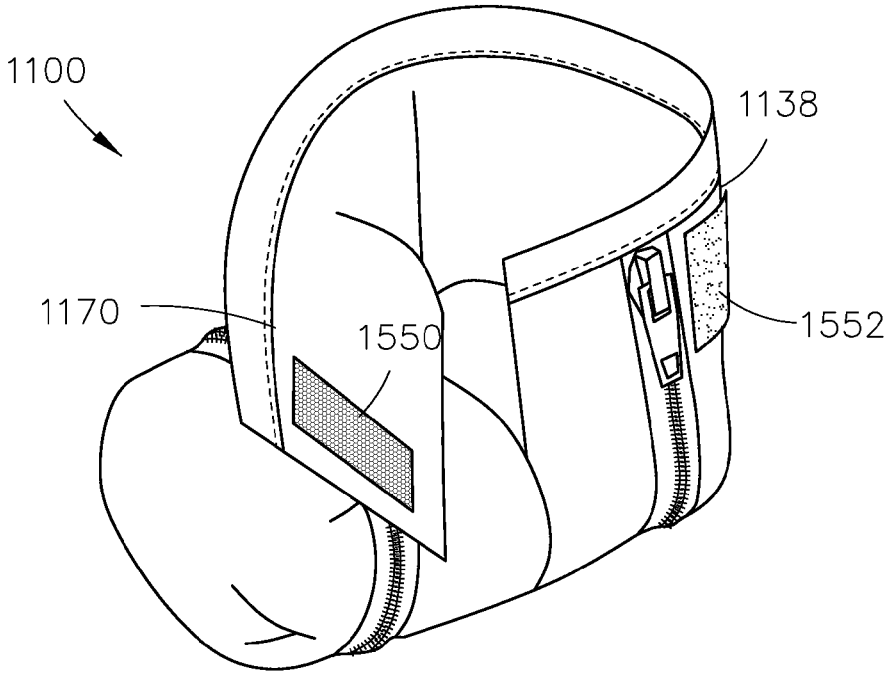
FIG. 15 is an illustration of a top perspective view of the expandable children's bootie of FIG. 11, showing the strap in an open position.
Figure 16:
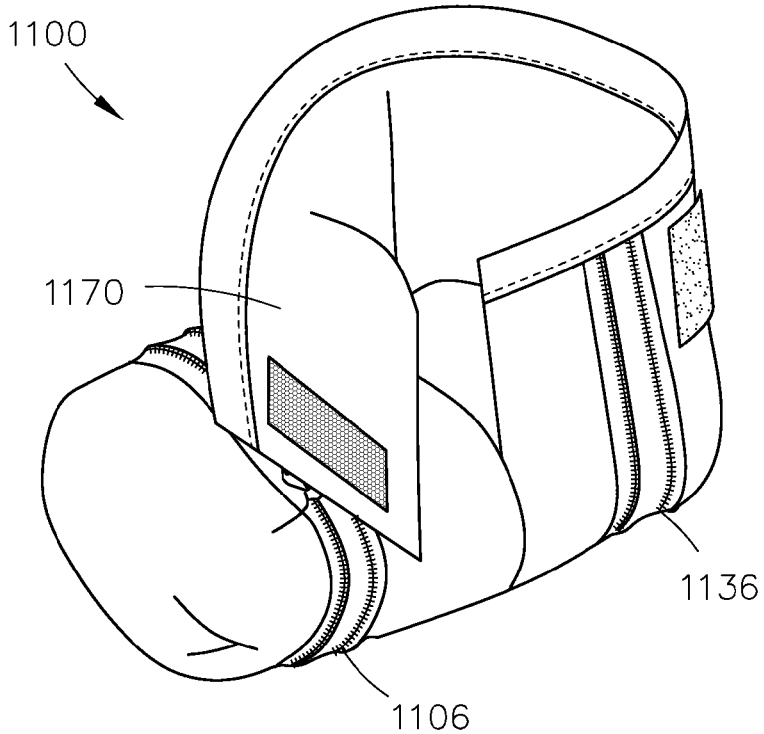
FIG. 16 is an illustration of a top perspective view of the expandable children's bootie of FIG. 11, showing the zippers and strap in an open position.

FIG. 15 is an illustration of a top perspective view of the expandable children's bootie 1100 of FIG. 11, showing the strap 1170 in an open position. FIG. 16 is an illustration of a top perspective view of the expandable children's bootie 1100 of FIG. 11, showing the zippers 1106, 1136 and strap 1170 in an open position. The bootie 1100 includes a strap 1170 comprising a strip extending substantially horizontally and connected to the ankle portion 1138 of the main body 1102. The strap 1170 includes a first portion 1550 of hook and loop fabric disposed on an interior side of the strap 1170. A second portion 1552 of hook and loop fabric is disposed on the ankle portion 1138 of the main body 1102, wherein the second portion 1552 of hook and loop fabric is coupled to the first portion 1550 of hook and loop fabric, so as to removably couple the strap 1170 with the ankle portion 1138 of the main body 1102. The strap 1170 may comprise border stitching around the top edge or topline of the strap 1170.

Figure 17:
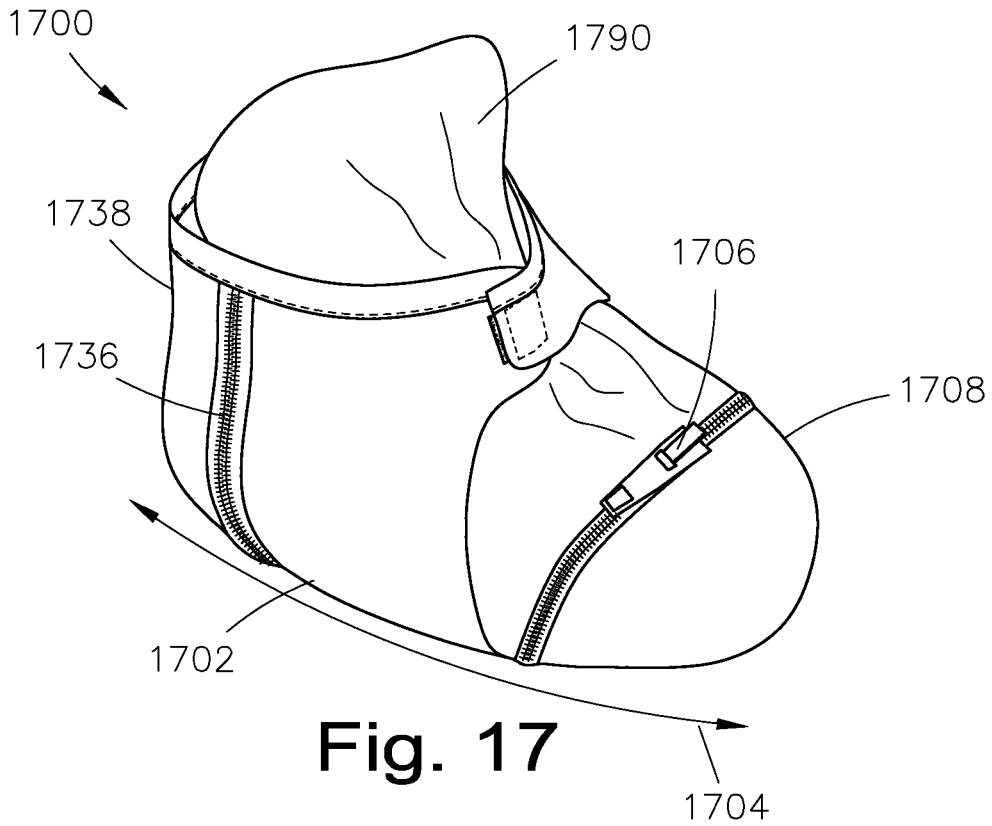
FIG. 17 is an illustration of a top perspective view of an expandable children's bootie, according to a fourth embodiment of the present invention.
Figure 18:
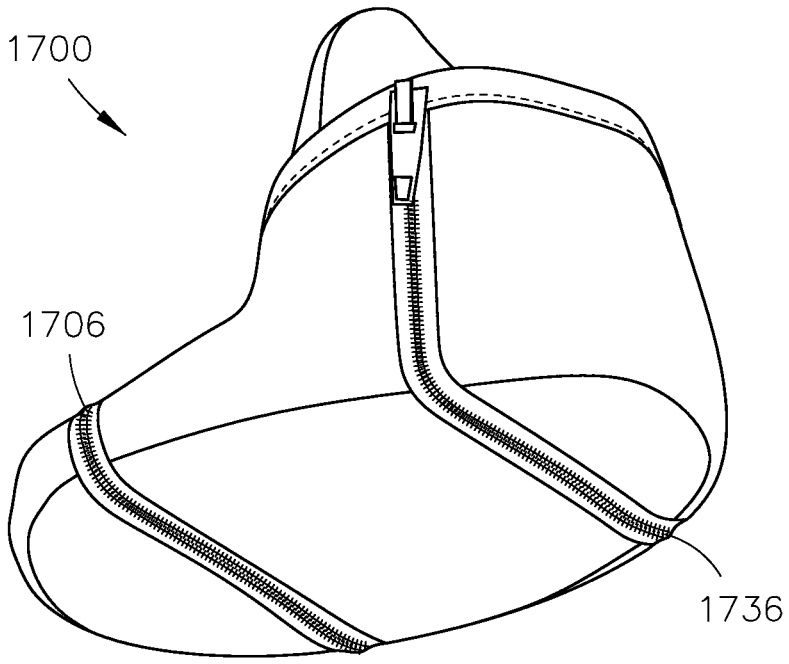
FIG. 18 is an illustration of a bottom perspective view of the expandable children's bootie of FIG. 17.

Following is a description of a fourth embodiment of Applicant's invention, with reference to FIGS. 17 through 20. FIG. 17 is an illustration of a top perspective view of an expandable children's bootie 1700, according to a fourth embodiment of the present invention. The bootie 1700 includes a main body 1702 composed of fabric, wherein the main body is shaped in the form of a foot having a longitudinal axis 1704. The bootie 1700 also includes a zipper 1706 embedded in the fabric of the main body 1702, wherein the zipper 1706 commences at a toe portion 1708 of the main body 1702, and extends around the main body 1702 such that the zipper 1706 twists at least three hundred and sixty degrees around the main body 1702. The bootie 1700 also includes a zipper 1736 embedded in the fabric of the main body 1702, wherein the zipper 1736 commences at a first side of an ankle portion 1738 of the main body 1702 and extends under the main body to reach a second side of the ankle portion 1738 of the main body 1702. FIG. 17 also shows that the bootie 1700 comprises a vamp and tongue 1790 composed of a single portion of fabric. FIG. 18 is an illustration of a bottom perspective view of the expandable children's bootie 1700 of FIG. 17.

Figure 19:
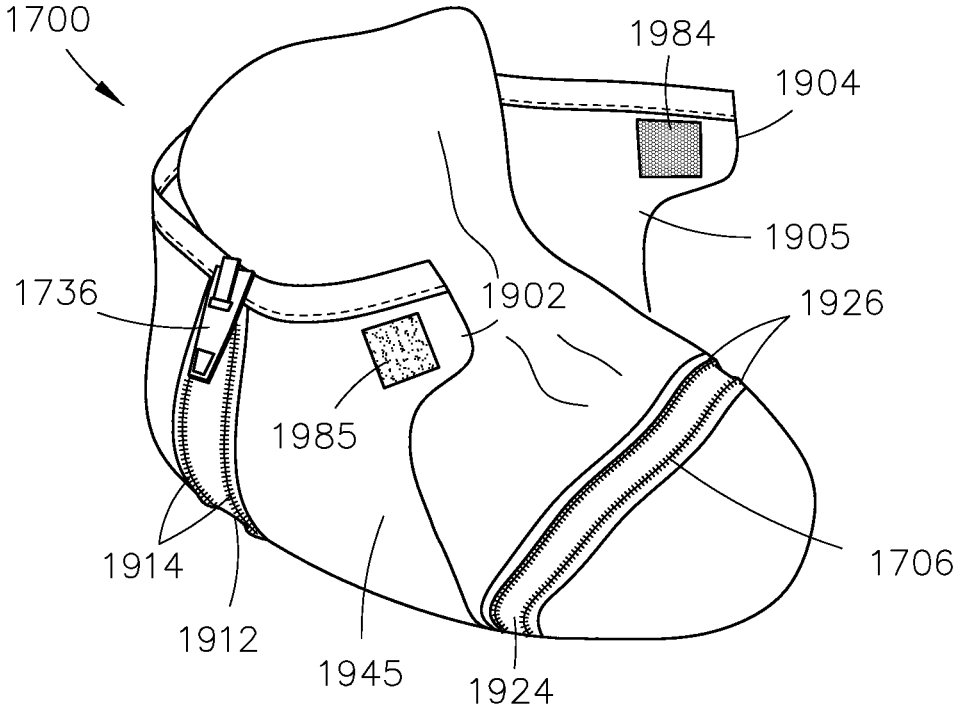
FIG. 19 is an illustration of a top perspective view of the expandable children's bootie of FIG. 17, showing the flaps and zippers in an open position.
Figure 20:
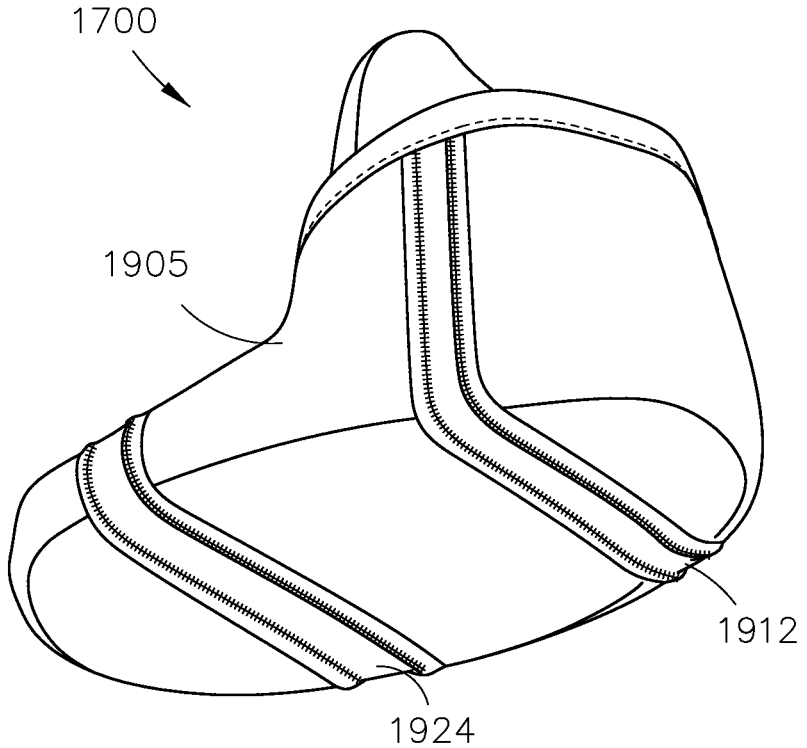
FIG. 20 is an illustration of a bottom perspective view of the expandable children's bootie of FIG. 17, showing the zippers in an open position.

FIG. 19 is an illustration of a top perspective view of the expandable children's bootie 1700 of FIG. 17, showing flaps 1902, 1904 and the zippers 1706 and 1736 in an open position. FIG. 19 shows that bootie 1700 includes a first portion 1912 of fabric disposed between mating tape members 1914 of the zipper 1736, wherein when the zipper 1736 is closed the first portion 1912 of fabric is contracted and the main body 1702 has a first longitudinal length along the longitudinal axis 1704, and wherein when the zipper 1736 is open the first portion 1912 of fabric is extended and the main body 1702 has a second longitudinal length greater than the first longitudinal length.

FIG. 19 also shows that bootie 1700 includes a second portion 1924 of fabric disposed between mating tape members 1926 of the zipper 1706, wherein when the zipper 1706 is closed the second portion 1924 of fabric is contracted and the main body 1702 has a third longitudinal length along the longitudinal axis 1704, and wherein when the zipper 1706 is open the second portion 1924 of fabric is extended and the main body 1702 has a fourth longitudinal length greater than the third longitudinal length.

The bootie 1700 further comprises a first flap 1904 composed of a section of a left side of the quarter 1905, wherein the first flap 1904 includes a first portion 1984 of hook and loop fabric disposed on a first side of the first flap 1904. In one embodiment, the first portion 1984 of hook and loop fabric may be the hook portion of fabric and the first side of the first flap 1904 may be the interior side of the first flap 1904. The first portion 1984 of hook and loop fabric may be secured to the first flap 1904 as described above for bootie 100, such as by stitching. FIG. 19 also shows that bootie 1700 comprises a second flap 1902 composed of a section of a right side of the quarter 1945, wherein the second flap 1902 includes a second portion 1985 of hook and loop fabric disposed on a second side of the second flap 1902. In one embodiment, the second portion 1985 of hook and loop fabric may be the loop portion of fabric and the second side of the second flap 1902 may be the exterior side of the second flap 1902. The second portion 1985 of hook and loop fabric may be secured to the second flap 1902 as described above for bootie 100, such as by stitching. The flaps may comprise border stitching around the top edge or topline of the flaps.

One or more of the components of the booties 100, 700, 1100 and 1700 may be composed of a variety of textiles or cloths. The textile or cloth can be any manner of flexible woven material consisting of a network of natural or artificial fibers. The textiles can be made from any of a variety of materials, including animal (wool, silk), plant (cotton, flax, jute), mineral (asbestos, glass fiber), and synthetic (nylon, polyester, acrylic).

The textiles from which the one or more of the components of the booties 100, 700, 1100 and 1700 may be manufactured in a variety of different ways, including weaving, knitting, spread tow, braising or felting. Weaving is a textile production method which involves interlacing a set of longer threads with a set of crossing threads. Mechanized knitting and crocheting involve interlacing loops of yarn, which are formed either on a knitting needle or on a crochet hook, together in a line. Spread tow is a production method where the yarn is spread into thin tapes, and then the tapes are woven as warp and weft. Braiding or plaiting involves twisting threads together into cloth. Knotting involves tying threads together and is used in making macrame. Felting involves pressing a mat of fibers together, and working them together until they become tangled. Nonwoven textiles are manufactured by the bonding of fibers to make fabric. Bonding may be thermal or mechanical, or adhesives can be used.

Further, although four specific embodiments are shown in FIGS. 1 through 20, the present invention supports additional embodiments. Additionally, the present invention supports alternative embodiments that include different combinations and permutations of the features shown in the four specific embodiments are shown in FIGS. 1 through 20. For example, one alternative embodiment of the present invention may include the flaps of 802, 804 of FIG. 7, the zipper 106 of FIG. 1, and the border stitching 116 of FIG. 1 around the topline of the bootie.

Although specific embodiments of the invention have been disclosed, those having ordinary skill in the art will understand that changes can be made to the specific embodiments without departing from the spirit and scope of the invention. The scope of the invention is not to be restricted, therefore, to the specific embodiments. Furthermore, it is intended that the appended claims cover any and all such applications, modifications, and embodiments within the scope of the present invention.

We claim:

1. An expandable bootie, comprising:

a main body composed of fabric, wherein the main body is shaped in the form of a foot having a longitudinal axis;

a zipper embedded in the fabric of the main body, wherein the zipper commences at a toe portion of the main body, and extends in a spiral path around the main body such that the spiral path twists at least three hundred and sixty degrees around the main body;

a portion of fabric disposed between mating tape members of the zipper, wherein when the zipper is closed the portion of fabric is contracted and the main body has a first longitudinal length along the longitudinal axis, and wherein when the zipper is open the portion of fabric is extended and the main body has a second longitudinal length greater than the first longitudinal length;

a strap comprising a strip extending substantially horizontally and connected to an ankle portion of the main body;

a first portion of hook and loop fabric disposed on an interior side of the strap; and a second portion of hook and loop fabric disposed on the ankle portion of the main body, wherein the second portion of hook and loop fabric is coupled to the first portion of hook and loop fabric, so as to removably couple the strap with the ankle portion of the main body.

2. The expandable bootie of claim 1, wherein a top edge of the strap comprises a topline of the bootie.

3. The expandable bootie of claim 2, wherein the strap comprises border stitching around the top edge of the strap.

4. The expandable bootie of claim 3, further comprising stitching that couples the first portion of hook and loop fabric to the interior side of the strap.

5. The expandable bootie of claim 4, further comprising stitching that couples the second portion of hook and loop fabric to the ankle portion of the main body.

6. The expandable bootie of claim 5, wherein the zipper further extends vertically up the ankle portion of the main body.

* * * * *